US005141134A

United States Patent [19]

Machado

[11] Patent Number: 5,141,134

[45] Date of Patent: Aug. 25, 1992

[54] PITCHER WITH SPOUT

[75] Inventor: Leonel H. Machado, Toronto, Canada

[73] Assignee: Robert Kuhi, Mississauga, Canada

[21] Appl. No.: 497,297

[22] Filed: Mar. 22, 1990

[51] Int. Cl.[5] ..... B67D 5/00

[52] U.S. Cl. ..... 222/83.5; 222/105; 222/465.1

[58] Field of Search ..... 222/81, 82, 83, 89, 222/90, 91, 105, 183, 465.1, 83.5; 215/11.3, 12.1; 206/222

[56] References Cited

U.S. PATENT DOCUMENTS

| | | | |
|---|---|---|---|
| Re. 32,354 | 2/1987 | Savage | 222/105 |
| 1,402,517 | 1/1922 | Kuno | 222/465.1 |
| 2,751,119 | 6/1956 | Manning | 222/81 |
| 2,828,890 | 4/1958 | Brownfield | 222/83 |
| 3,108,717 | 10/1963 | Kindseth | 222/89 |
| 3,278,083 | 10/1966 | Serafini | 222/91 |
| 3,861,565 | 1/1975 | Rickmeier | 215/12.1 |
| 4,265,372 | 5/1981 | Wainberg | 222/82 |
| 4,561,560 | 12/1985 | Lyon | 222/183 |

FOREIGN PATENT DOCUMENTS

| | | | |
|---|---|---|---|
| 967998 | 11/1950 | France | 215/12.1 |

*Primary Examiner*—Kevin P. Shaver
*Assistant Examiner*—Gregory L. Huson
*Attorney, Agent, or Firm*—Bereskin & Parr

[57] ABSTRACT

A pitcher for use in dispensing liquid from a flexible-walled, liquid containing pouch. The pitcher includes a container adapted for receiving a pouch, and a cover adapted for engagement with the container. A cylindrical sleeve is mounted on the cover in conjunction with a spout having a piercing point for piercing the wall of the pouch and a hollow cylindrical portion having an access port in a wall thereof for communication with a pouring portion of the spout. The sleeve receives the cylindrical portion of the spout and is adapted for forming a seal with a puncture hole in the wall of the pouch formed by the piercing point of the spout. The spout is slideably moveable relative to the sleeve and is capable of movement between a sealing configuration, in which the sleeve covers the access port, and a pouring configuration in which the access port is exposed. A pusher member is mounted on the cover for pushing downwardly on the wall of the pouch to push the wall adjacent the sleeve and spout up and into engagement with the piercing point as the cover is pushed downwardly on the container.

37 Claims, 8 Drawing Sheets

PITCHER WITH SPOUT

FIELD OF THE INVENTION

This invention relates to a pitcher for use in dispensing liquid from a flexible-walled, liquid containing pouch.

Although the term pouch is used herein, this is intended to encompass liquid containers commonly referred to as pouches, cartons, bags, packs and the like, in which at least a wall portion of the container is flexible.

BACKGROUND OF THE INVENTION

Liquids are frequently stored, transported and sold to consumers in disposable, flexible-walled, liquid containing pouches or packs. One of the most familiar pouches are those used for containing milk, and in many areas such pouches have substantially replaced returnable glass milk bottles and waxed paper cartons. However, such flexible pouches are also used for containing other liquids, such as detergents and fabric softeners, the consumer buying the liquid in the flexible container, and transferring the liquid into a conventional rigid, resealable container for everyday use.

Although it is possible to transfer a liquid from a flexible pouch, as mentioned above, into a jug or other rigid container, it can be difficult to carry out such an operation without spillage and many persons prefer to dispense the liquid directly from the flexible pouch. Where milk is sold in flexible pouches, oval, open topped plastic pitchers are often available, the pouch being placed in the pitcher and having one corner cut off to provide a dispensing opening. There are various problems associated with this method of dispensing milk, it being difficult to produce an opening in the pouch which will pour smoothly without dripping, and many persons do not find the pitcher and pouch arrangement aesthetically pleasing. Also, as the milk is used, the pouch tends to become loose in the pitcher making pouring more difficult, and possibly leading to the pouch falling from the pitcher during pouring.

If it is desired to seal the pouch in this form of pitcher a separate spring clip is required.

Various spouts and containers have been proposed for use in dispensing liquids, particularly milk, from flexible plastic pouches. In Canadian Patent No. 1,083,534 to Wainberg various forms of dispensers are provided for containing a flexible pouch. The pouch is placed in the container which is fitted with a lid, and a hole is then cut or pierced in the pouch by blades of one of a variety of configurations. It does not appear from the disclosure that the pouch is held in place relative to the container.

Canadian Patent No. 1,219,839 to Borg discloses a pouch piercing device and spout, the spout being configured such that the open end of the spout must be covered by a person's thumb when they push the spout into the milk pouch which is held with the other hand for proper presentation to the spout. The pouch is stretched by the spout as it is pushed into the pouch, and grips the spout above access ports provided rearwardly of the piercing end of the device, by means of grooves which act as barbs.

Canadian Patent No. 1,233,434 to Marcotte discloses a conical spout for mounting on a conventional pouch containing pitcher, as described above. For sealing the spout, a closure cap is pivotally mounted over the open end of the spout.

Canadian Patent No. 1,254,540 to Farquharson, discloses a milk bag pitcher for containing a milk pouch and in which an opening is cut in a corner of the milk pouch by means of a zipper-like blade. It does not appear that the cut pouch is held in position in the container. The container includes a post extending from its base to push up a corner of the pouch for convenient cutting by the blades.

Other patents disclose devices and spouts intended for use with waxed paper cartons, including U.S. Pat. No. 2,598,843 to Sherwood in which a simple pouring spout is disclosed. The spout comprises a hollow cylindrical tubular member which is closed by a solid stopper which extends through the tubular member, the stopper closing off side and end apertures in the tubular member. To allow pouring, the stopper is removed from the tubular member.

Other patents in which spouts and devices for use with waxed paper cartons are disclosed include: Canadian Patent No. 1,124,687 to Desjardins; U.S. Pat. No. 3,902,652 to Malcolm; U.S. Pat. No. 4,561,560 to Lyon; and U.S. Pat. No. 4,723,689 to Vallos et al.

Other patents which were considered in the preparation of this patent application include: U.S. Pat. Nos. 3,190,537 and 3,642,172 to Meinecke et al and Malpas, respectively, which relate to bulk containers comprising a carton with a flexible bag liner; U.S. Pat. Nos. 1,350,908, 2,547,311 and 2,556,311 to York, Genovese and Winkler, respectively, which relate to can holders provided with means for puncturing an end of the can to allow dispensing of the liquid contained in the can; and U.S. Pat. No. 4,696,411, which relates to a chemical vessel with an access tube closed at the internal end with a breakseal, and a removal tube slideably mounted in gas tight relationship in the access tube and moveable to break out the breakseal.

SUMMARY OF THE INVENTION

According to the present invention there is provided a pitcher for use in dispensing liquid from a flexible-walled, liquid containing pouch. The pitcher comprises a container, a sleeve, a spout for location in the sleeve and a support member on the container for mounting one of the sleeve and spout. The container is substantially rigid and is adapted for containing a flexible-walled, liquid containing pouch. One of the spout and sleeve is provided with a piercing end of tapering cross-section for piercing a wall of the pouch. The spout is provided with an access port spaced from the piercing end and in fluid communication with a pouring portion of the spout. The sleeve includes a sealing portion for forming a seal with a puncture hole in the pouch, rearwardly of the piercing end. When the spout and sleeve are being pushed into a pouch, the spout is located in a sealing and piercing configuration in which the sleeve covers the access port. Once the spout and sleeve have been positioned in the pouch, the spout may be moved to a pouring configuration in which the access port is exposed inwardly of the sealing portion to allow liquid to be dispensed from the pouch.

In accordance with a further aspect of the present invention there is provided a pitcher for use in dispensing liquid from a flexible-walled, liquid containing pouch comprising a container provided with a cover, a sleeve and a pusher member being mounted in the cover, and a spout being mounted in the sleeve. The container is cylindrical, substantially rigid and open-topped and has a base, a side-wall and a handle. The container is dimensioned to receive a flexible-walled, liquid containing pouch and the cover is adapted to engage an upper portion of the side wall of the container. The sleeve is cylindrical and extends through the cover to provide mounting for the spout, which has a conical piercing end for puncturing the wall of the pouch and a hollow cylindrical portion having an access port in a wall thereof for communication with a pouring portion of the spout. The sleeve is adapted for forming a seal with the puncture hole formed by the piercing end of the spout. The spout is slideably moveable in liquid tight relationship in the sleeve and is capable of movement between a sealing and piercing configuration in which the sleeve covers the access port, and a pouring configuration in which the access port is exposed beyond the end of the sleeve. The pusher member extends inwardly from the cover and is spaced from the sleeve for pushing downwardly on a side of the wall of the pouch and to push the other side of the wall into engagement with the piercing end of the spout as the cover is pushed downwardly onto the container and thus facilitates piercing of the pouch by the spout.

The pitcher may further include detents between the cover and the container for retaining the cover in one of a series of positions, depending on the size of pouch in the container.

In use, a pouch containing, for example, milk is placed in the container. The cover, with the spout in the sealing and piercing configuration, is then pushed down over the container such that the piercing end of the spout engages one side of the upper wall of the pouch, and the pusher member engages the other side. As the cover is pushed down onto the container, the pusher member pushes the other side of the pouch downwardly, the one side of the pouch projecting above this other side such that any air in the pouch gathers in the one side. As the pouch, which is restrained by the container, is compressed by the pusher and the spout, the pouch wall becomes taut, and pushing the cover down still further causes the conical piercing end of the spout to puncture the pouch wall. The piercing end of the spout, and a portion of the sleeve, pass through the wall of the pouch. After the initial puncture has been formed, the puncture hole in the pouch wall is stretched by the spout and the sleeve, such that the hole edge elastically seals around the sleeve.

The covering or sealing of the access port by the sleeve during the piercing operation prevents leakage from the pouch when the pressurized pouch is punctured.

To dispense liquid from the pouch, the spout is moved to the pouring configuration, in which the access port is exposed. When the container is tilted, liquid may drain through the access port and the pouring portion of the spout from the pouch and out of the container. To re-seal the pouch, the spout is returned to the sealing and piercing configuration.

As the edge of the puncture in the pouch wall is stretched around the sleeve, the pouch wall grips the sleeve and the pouch is retained on the sleeve as the liquid is drained from the pouch. When the pouch is empty, the cover is removed from the container, with the pouch still attached to the sleeve. The empty pouch may then be discarded, and a replacement pouch placed in the container.

In accordance with a still further embodiment of the present invention there is provided a pouring spout for use in dispensing liquid from a flexible-walled, liquid containing pouch comprising a sleeve and a spout for location in the sleeve portion and having ends extending from the sleeve. A piercing point of tapering cross-section for piercing a wall of a pouch is provided on one of the sleeve and spout, the spout having an access port rearwardly of the piercing point for communication with a pouring portion of the spout. The spout is moveable relative to the sleeve, between a sealing configuration, in which the sleeve covers the access ports and the piercing point may puncture a pouch wall, the piercing point being pushed into the pouch such that the edge of the puncture hole sealingly engages the sealing portion of the sleeve, and a pouring configuration in which the access port is exposed inwardly of the sealing portion. The pouring spout may be mounted on a pitcher or the like or may be mounted directly on a self-standing pouch.

BRIEF DESCRIPTION OF THE DRAWINGS

These and other embodiments of the present invention will now be described, by way of example, with reference to the accompanying drawings, in which.

DETAILED DESCRIPTION OF DRAWINGS

Figure 1:
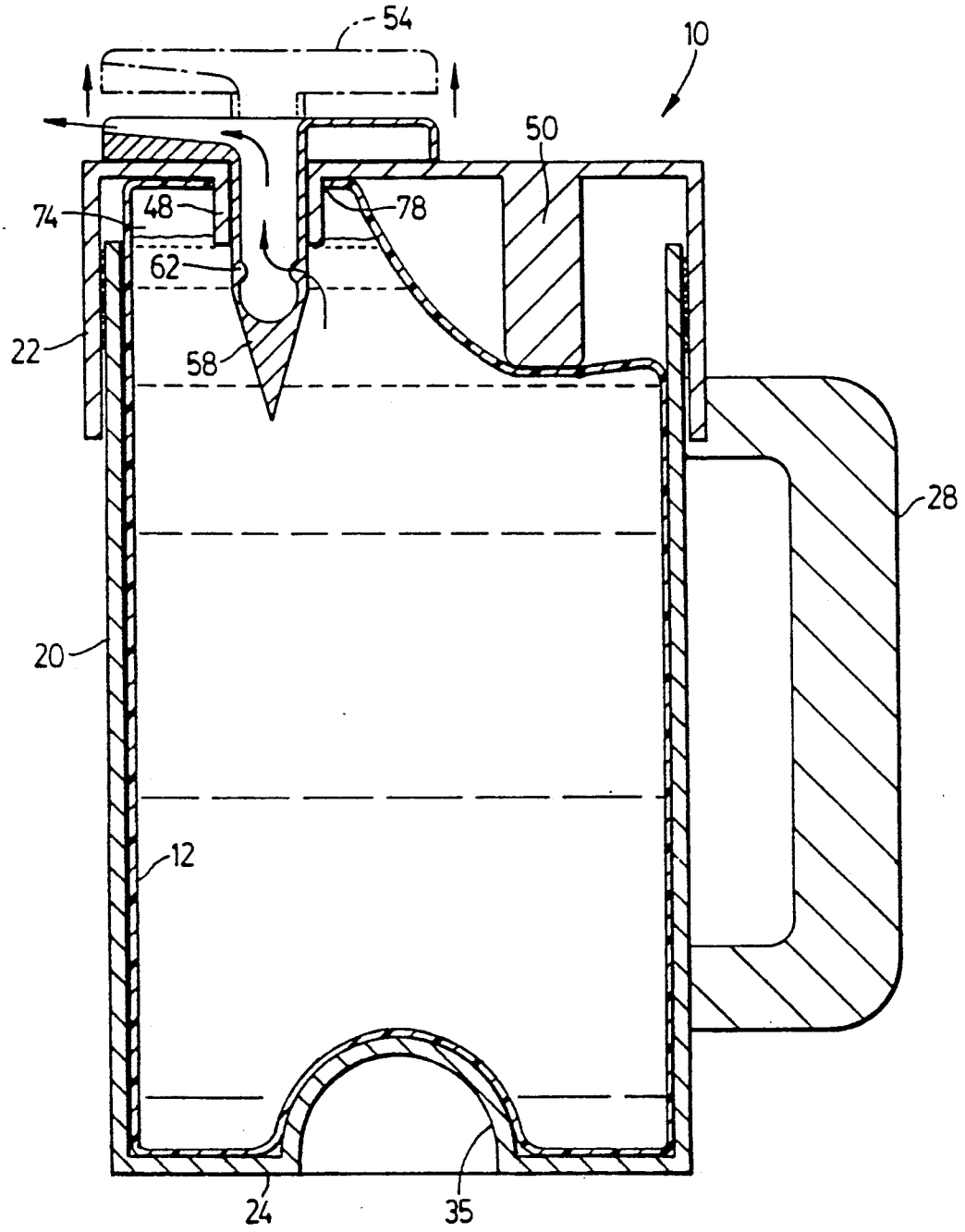
FIG. 1 shows a pitcher in accordance with a preferred embodiment of the present invention and including a representation of a flexible-walled, liquid containing pouch.

Reference is first made to FIG. 1 of the drawings which illustrates a pitcher, generally indicated at 10, intended for use in dispensing liquid from flexible-walled pouches 12. It should, however, be noted that the invention is not limited to use with pouches of the configuration described below and illustrated in the drawings, but may be used with many different forms of pouches or cartons having at least a portion of wall which is flexible and which may be punctured and sealed as will be described hereinbelow.

The pouch 12 illustrated is similar to the pouches commonly used for the storage of milk, and is fabricated from a flexible plastic sheet formed into a tube which has its ends sealed to provide a sealed container. A pouch 12 of this form typically contains the liquid and a small volume of air.

Figure 2C:
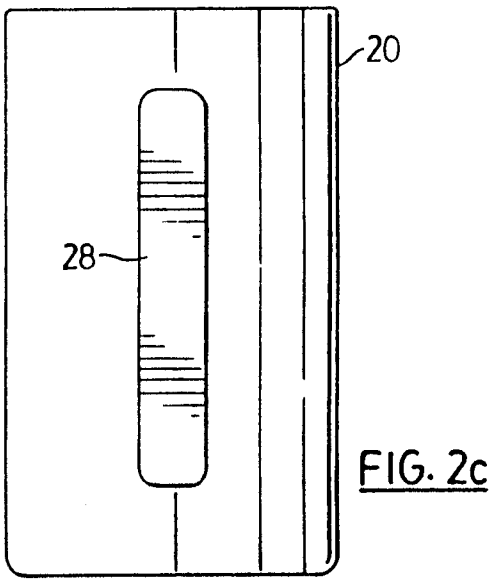
FIGS. 2*a*–2*c* show the container forming part of the pitcher of FIG. 1.
Figure 2A:
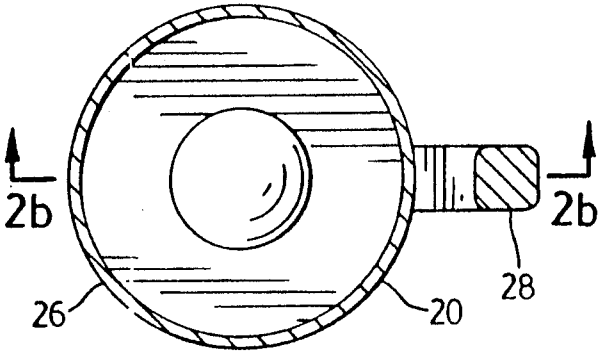
Figure 2B:
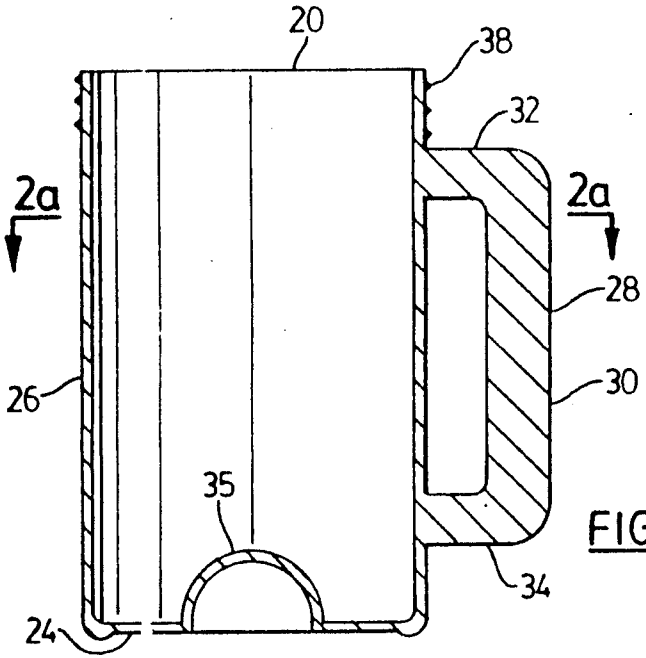

The pitcher 10 comprises a container 20 and a cover 22. For use with the pouch 12 described above, the container 20, shown somewhat enlarged in FIGS. 2*a*–2*c*, is of cylindrical shape and includes a base 24 and a cylindrical side-wall 26. Fixed to the side-wall is a handle 28 including a grip portion 30 with portions 32, 34 extending from the ends thereof for fixing the grip portion 30 to the side-wall 26.

Extending from the base of the container 20 is a rounded protrusion 35 for engaging a lower portion of the pouch 12, the purpose of which will be described hereinbelow.

Figure 3A:
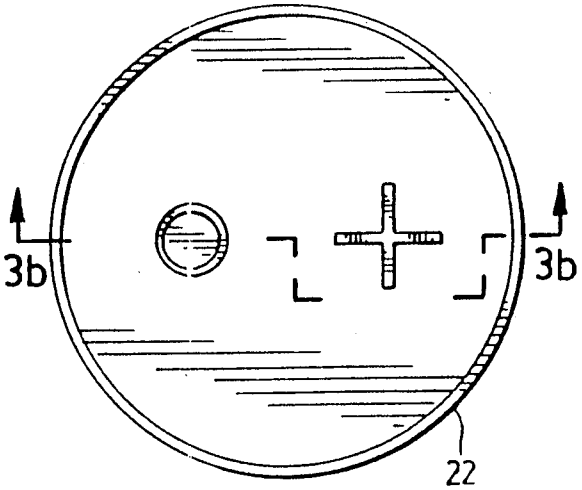
FIGS. 3*a*–3*c* show the cover for the pitcher of FIG. 1.
Figure 3B:
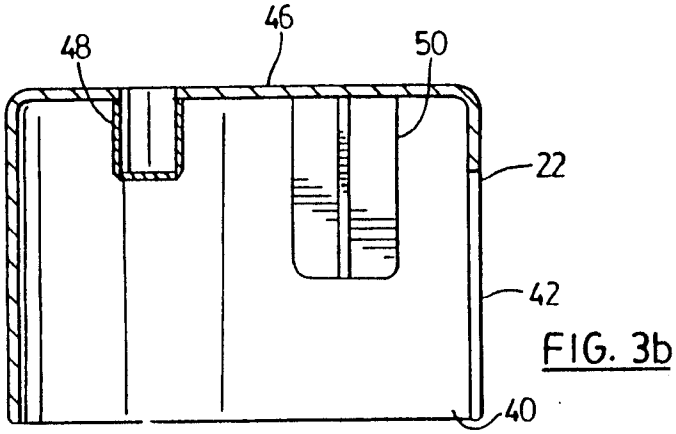
Figure 3C:
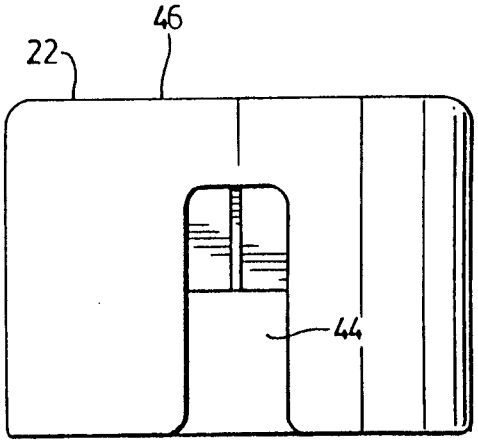

In this example, the upper portion of the side-wall 26 includes detents 38 for engaging corresponding detents 40 provided on an inside surface of a side-wall 42 of the cover 22 which is also generally cylindrical, and sized to fit snugly over the upper end of the container. The cover is shown separately in FIGS. 3*a*–3*c* of the drawings. The cooperating detents 38, 40 allow the cover 22 to be held on the container 20 in one of a series of preselected locations, the purpose of which will be described hereinbelow.

The side-wall 42 of the cover 22 is provided with a longitudinal slot 44 which is just wide enough to accommodate the upper portion 32 of the handle 28, such that the cover may only be fitted to the container in one particular alignment.

Figure 4A:
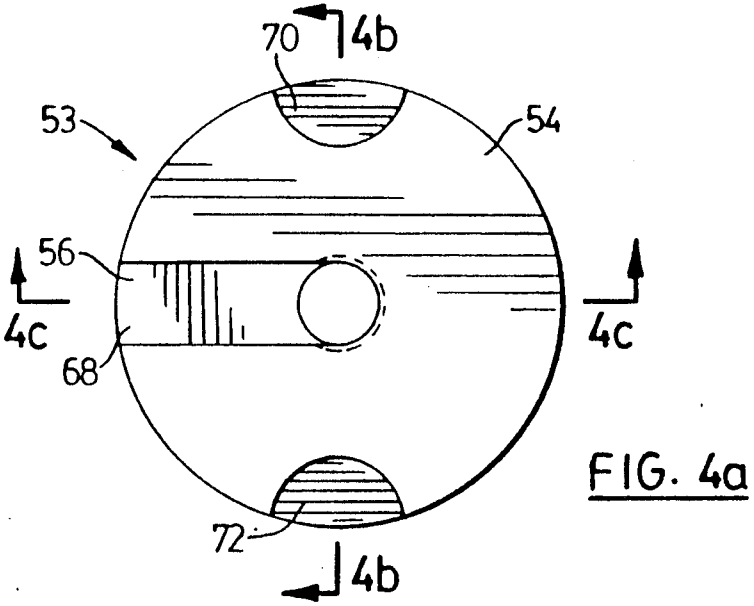
FIGS. 4*a*–4*c* show the spout for the pitcher of FIG. 1.
Figure 4C:
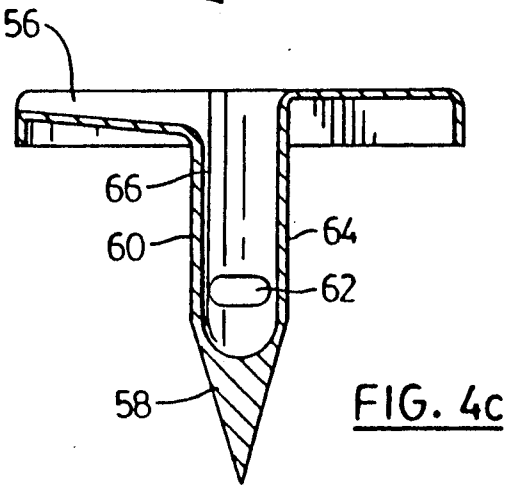
Figure 4B:
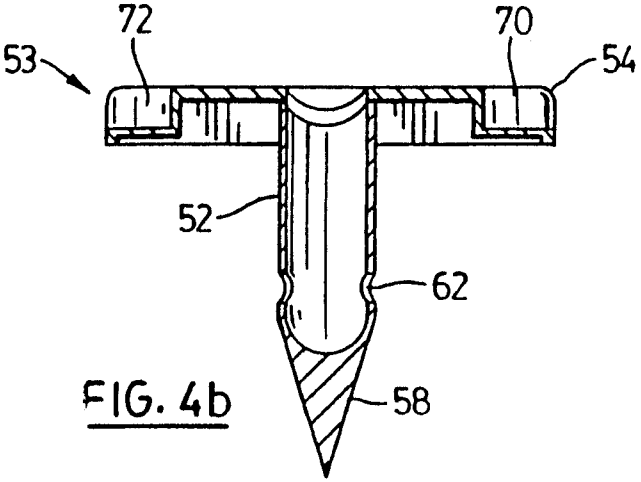

The cover 22 also includes a top 46 from which an integral sleeve 48 and an integral pusher member 50 depend. The pusher member 50, for ease of manufacture, is cruciform and extends from one side of the top 46, longitudinally of the cover 22. In a further embodiment, the pusher member could equally well be cylindrical with a rounded lower end. The sleeve 48 is located on the other side of the cover and similarly extends longitudinally of the cover. The sleeve 48 is cylindrical, has a relatively narrow wall thickness, and is sized to form a close, preferably liquid tight fit with a spout 52, shown separately in FIGS. 4*a*–4*c*.

The spout 52 extends perpendicularly from a disc 54 which defines a pouring portion 56 and which, in the assembled pitcher 10, is located on the outer side of the top 46. The spout comprises a conical piercing end 58 which extends from a hollow cylindrical portion 60. The piercing end 58 is substantially solid, while the cylindrical portion 60 is hollow, two oval access ports 62 being provided in the portion wall 64, spaced rearwardly of the piercing end 58. The passage 66 formed in the hollow portion 60 extends through the disc 54 and to one end of a radially extending channel 68 which defines the pouring portion 56 and is formed in an upper surface of the disc 54.

In this particular example, the disc 54 further includes diametrically opposed finger recesses 70, 72 which facilitate rotation of the spout. Cooperating screw threads are formed on the exterior of the cylindrical portion 60 and the interior of the sleeve 48 such that rotation of the spout causes a longitudinal movement of the spout relative to the cover, the purpose of which movement will be described hereinbelow. The ends of the threads may be provided with detents to releasably retain the probe in the configurations which the screw threads permit movement between.

In use, a pouch 12 is placed in the container 20 and engages the base 24 and the protrusion 35. The spout is then rotated such that the access ports 62 are located within the sleeve, only the conical piercing end 58 of the spout 52 extending beyond the end of the sleeve. The cover 22 is then pushed down onto the container 20, the detents 38, 40 causing the cover to move downwardly in series of steps. As the cover is pushed down, the piercing end of the spout engages one side of an upper wall of the pouch and the pusher member 50 engages the other side. The pusher member 50 extends beyond the spout and thus pushes the other side of the pouch downwardly into the container such that the one side extends above the other side, and any air in the pouch collects in the one side, as indicated at 74 in FIG. 1. As the cover is pushed further downwards onto the container, the pouch wall becomes taut, the piercing end 58 of the spout 52 eventually puncturing the pouch wall. When the wall is punctured, the piercing end and a portion of the sleeve 58 pass into the interior of the pouch, the puncture hole being stretched as the piercing end passes through the pouch wall. Thus, when movement of the cover is stopped (the operator may feel a "pop" indicating that the pouch has been punctured), the elastic pouch wall forms a seal around the sleeve 48 at a sealing portion 78.

The sealing of the access ports by the sleeve during this operation prevents leakage when the puncture is formed, which would otherwise be liable to occur as the edge of the hole in the pouch passes over an open port and the fluid in the pouch flows around the edge of the port, in addition to any leakage through the spout. Further, if there should be any loss of seal between the cylindrical portion of the probe and the sleeve, the location of the "air pocket" 74 results in only air leaking from the pouch.

The protrusion 35 is provided to increase the tension in the pouch wall as the cover is pushed down onto the container. The protrusion 35 is just one example of how this may be achieved, and other container configurations may be used to ensure that the pouch wall is taut, to facilitate puncture by the spout.

The provision of a series of detents 38, 40 on the cover and container cause the cover to be releasably retained on the container in an appropriate position, depending on the size of the pouch.

To dispense liquid from the pouch 12, an operator rotates the disc 54 such that the spout moves downwardly and the access ports 62 become accessible beyond the end of the sleeve 48. The screw threads between the sleeve and spout are configured such that this position corresponds with the channel 68 extending towards the closest edge of the cover, away from the handle, and on tipping the container 20, liquid will flow from the pouch, through the access ports 62, the passage 66 and the channel 68. To reseal the pouch, the operator rotates the disc 54 in the opposite direction to bring the spout back from the pouring configuration to the original sealing and piercing configuration.

Thus, it may be appreciated from the above description, that the pitcher provides a convenient means for dispensing liquid from a flexible-walled container, the container and pitcher concealing the pouch which is sealingly retained therein.

Further, the pitcher as described above, may be formed of only three separate, moulded, plastic parts, though other suitable materials and fabrication processes may be utilized. Other sleeve and spout configurations are also possible, three of these being described below.

Figure 5:
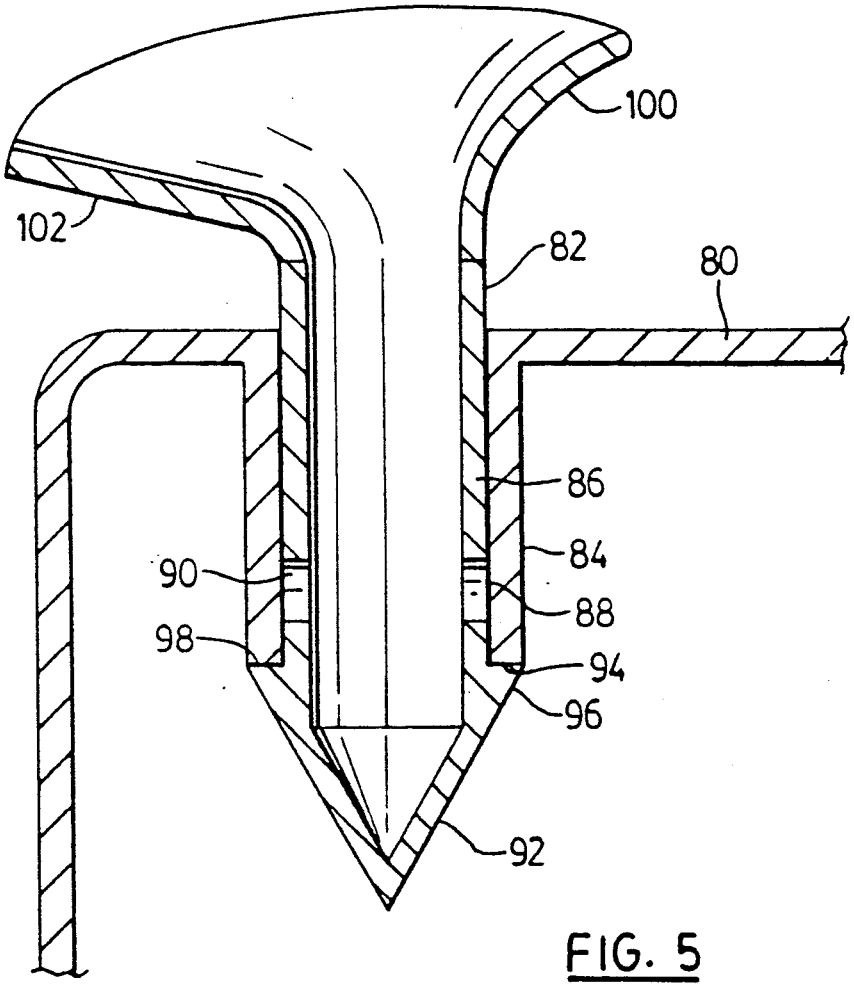
FIGS. 5 to 8 are sectional scrap views of the cover and spout of pitchers in accordance with a further embodiments of the present invention.

FIG. 5 of the drawings is a sectional, scrap view of the cover 80 and spout 82 in accordance with a further embodiment of the present invention. The cover 80 is provided with a cylindrical sleeve 84 which receives a cylindrical portion 86 of the spout which includes two diametrically opposed access ports 88, 90 spaced rearwardly from the conical piercing end 92 of the spout. The sleeve and spout configuration of this example differs somewhat from the above-described embodiment in that the sleeve 84 has a truncated end 94 which is not provided with a taper. Thus, in order to provide a smooth transition between the piercing end 92 and the sleeve 84, the base 96 of the piercing end extends beyond the sleeve 84 to a diameter equal to that of the sleeve. FIG. 5 illustrates the spout in the piercing and sealing configuration in which the end of the sleeve 84 abuts an annular ledge 98 formed at the base of the piercing end which acts as a stop means for stopping the spout when the spout is moved to a sealed position.

In this particular embodiment, movement of the spout 82 between the piercing and sealing configuration and the pouring configuration is simply achieved by pushing or pulling on the spout 82. For this reason, the spout is provided with a lip 100 on the opposite side of the spout from the pouring portion 102.

By forming the spout 82 in this shape it is difficult to provide a unitary spout, such that the cylindrical portion 86 and piercing end 92 are formed as a separate part from the pouring portion 102 and the lip 100, which parts are then joined on assembly of the pitcher.

Figure 6:
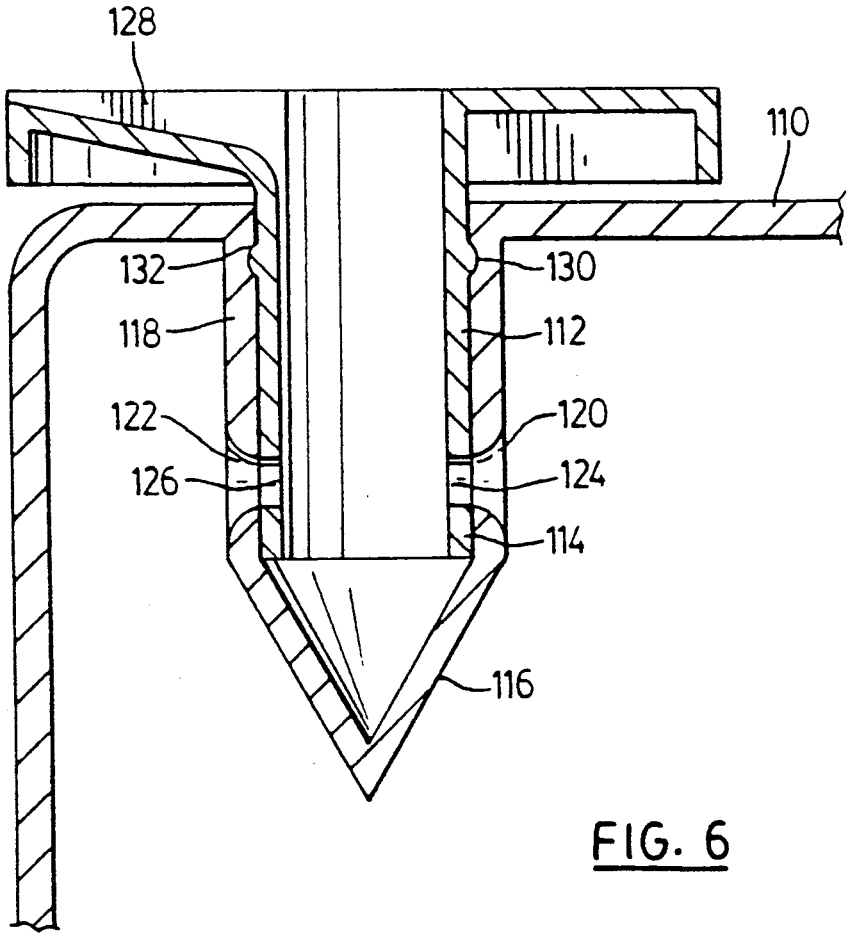

Reference is now made to FIG. 6 of the drawings which shows a sectional, scrap view of the cover 110 and spout 112 of a pitcher in accordance with a still further embodiment of the present invention. In this example, the spout 112 includes a cylindrical portion 114, however the piercing means are provided in the form of a piercing end 116 of the sleeve 118. The conical piercing end 116 closes the end of the sleeve 118 and fluid communication between the exterior of the sleeve and the interior of the sleeve is solely provided by means of two diametrically opposed access ports 120, 122. In FIG. 6 the spout 112 is illustrated in the pouring configuration such that spout access ports 124, 126 are located in line with the access ports 120, 122 of the sleeve. Thus, fluid may flow through the aligned access ports, through the hollow cylindrical portion 114 and through a channel 128 provided in the pouring portion of the spout.

To move the spout 112 to the sealing configuration the spout is simply rotated through 90° such that the access ports of the sleeve and spout are misaligned, the wall of the cylindrical portion 114 closing the access ports 120, 122. Detents 130, 132 are provided between the spout 112 and sleeve 118 to provide positive location for the spout 112 and also retain the spout in the sleeve, while allowing the spout to be removed from the sleeve for cleaning.

Figure 7:
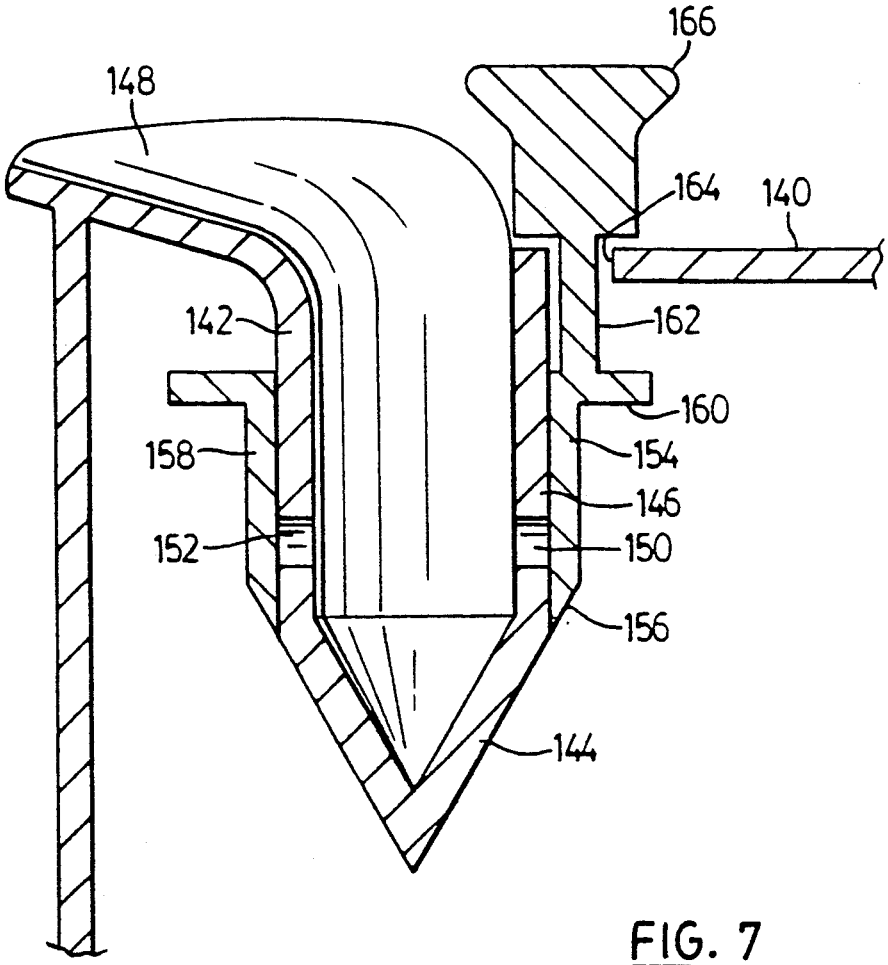

Reference is now made to FIG. 7 of the drawings which is a sectional, scrap view of the cover 140 and spout 142 of a pitcher in accordance with a yet further embodiment of the present invention. In this example, the spout 142 is integral with the cover 140 and includes a piercing end 144, a cylindrical portion 146 and a pouring portion 148. Access ports 150, 152 are provided in the cylindrical portion 146 and, in FIG. 7, are shown closed by a valve member or sleeve 154 which is slideably mounted on the exterior of the spout 142 and has a tapered end 156, the taper corresponding to that of the piercing end 144 of the spout. The sleeve 154 is provided with a sealing portion 158, for sealing engagement with the edges of a hole formed in a pouch, and rearwardly of the sealing portion 158 is a flange 160 which limits the travel of the pouch wall on the sleeve.

Movement of the sleeve 154 is achieved by use of an operating portion 162 which extends from the flange 160 through an aperture 164 in the top wall of the cover and includes an enlarged knob 166 located on the exterior of the cover which an operator pulls upwardly to move the sleeve to the pouring configuration and pushes downwardly to move the sleeve to the piercing and sealing configuration.

Figure 8:
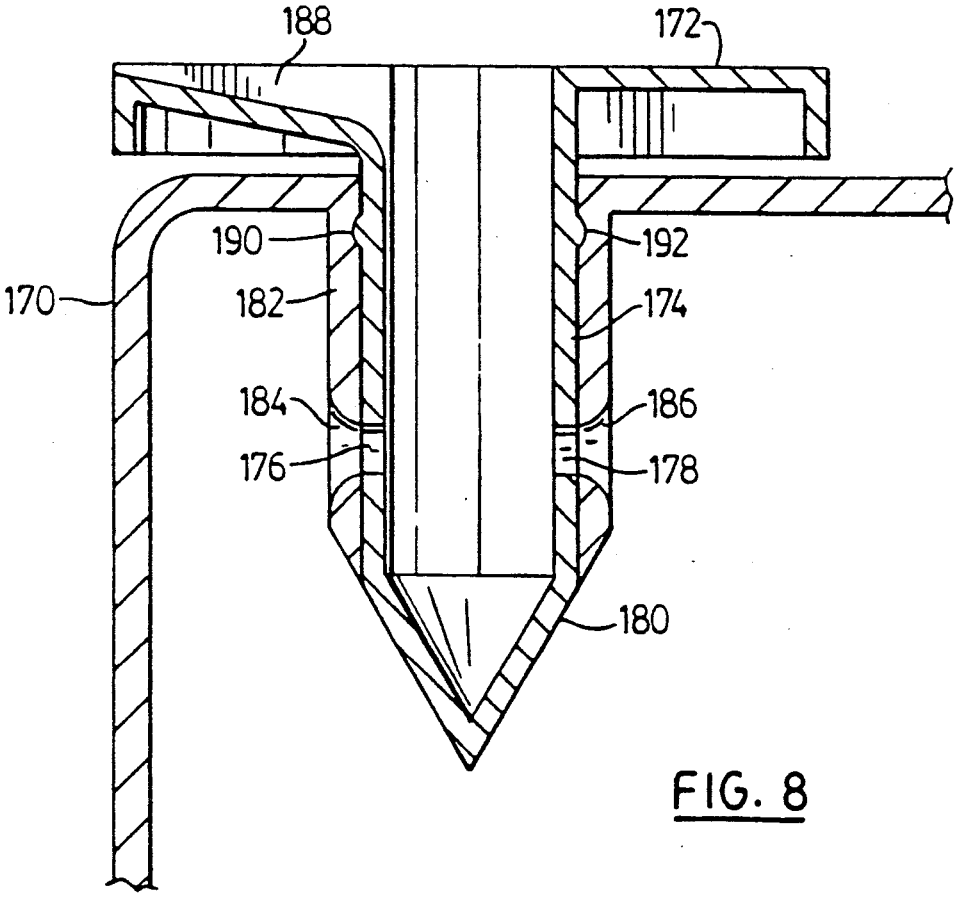

Reference is now made to FIG. 8 of the drawings which shows a sectional, scrap view of the cover 170 and spout 172 of a pitcher in accordance with a further embodiment of the present invention. In this example, the spout 172 includes a cylindrical portion 174 which includes two diametrically opposed access ports 176, 178 spaced rearwardly from the conical piercing end 180 of the spout. The cylindrical portion 174 is received by the sleeve 182 which is provided with access portion 184, 186 which, in the pouring configuration, are aligned with the access ports 176, 178 of the spout. Thus, fluid may flow through the aligned access ports, through the hollow cylindrical portion 174 and through a channel 188 provided in the pouring portion of the spout.

To move the spout 172 to the sealing configuration the spout is simply rotated through 90°, such that the access ports of the sleeve and spout are misaligned, the sleeve closing the access ports 176, 178. Detents 190, 192 are provided between the spout 172 and sleeve 182 to provide positive location for the spout 172 and also to retain the spout in the sleeve, while allowing the spout to be removed from the sleeve for cleaning.

In other embodiments of the present invention, pouring spouts comprising only a spout and a sleeve, separate from a cover, may be provided for use with conventional open-topped pitchers or for use with self-supporting pouches or cartons.

It will be clear to those skilled in the art that the above-described examples are merely exemplary of the present invention, and that various modifications and improvements may be made to the described pitchers and sleeve and spout arrangements without departing from the scope of the invention.

I claim:

1. A pitcher for use in dispensing liquid from a flexible-walled, liquid containing pouch comprising:

a substantially rigid container adapted to receive the flexible-walled, liquid containing pouch;

wall piercing means of tapering cross-section for puncturing a wall of the pouch;

a spout having an access port spaced from the wall piercing means and in fluid communication with a pouring portion of the spout;

a sleeve for receiving the spout and having a sealing portion for forming a seal with a puncture hole in the pouch outwardly of the wall piercing means, the spout being movable relative to the sleeve between a sealing configuration in which the sleeve covers the access port, and a pouring configuration in which the access port is exposed inwardly of the sealing portion; and support means for mounting one of the spout or sleeve on the container, the wall piercing means being provided on one of the spout or sleeve; and, a pusher member on one of the container or the support means for pushing against a wall of the liquid containing pouch to make the walls of the pouch taut prior to puncturing by the wall piercing means.

2. The pitcher of claim 1, wherein the pusher member is mounted on the support means, the pusher member being spaced from the sleeve and spout and adapted for pushing downwardly on one side of a wall of a pouch and to push the other side of the wall of the pouch into engagement with the wall piecing means.

3. The pitcher of claim 1, wherein the container includes a base and a side-wall, the support means being adapted for mounting to the side-wall.

4. The pitcher of claim 3, wherein the support means is removable from the container to permit placement of a pouch in the container.

5. The pitcher of claim 4, wherein detent means is provided between the support means and the side-wall of the container for retaining the support means in one of a series of relative positions.

6. The pitcher of claim 4, wherein the support means is in the form of a cover.

7. The pitcher of claim 5, wherein the support means is in the form of a cover.

8. The pitcher of claim 6, wherein a handle is provided on the container and extends longitudinally of the side-wall of the container, and the cover includes a top and a side-wall, the side-wall of the cover including an open-ended slot for accommodating an upper end portion of the handle.

9. The pitcher of claim 6, wherein the wall piercing means is provided at a piercing end of the spout.

10. The pitcher of claim 9, wherein the spout further includes a tubular portion including the access port and extending rearwardly of the piercing end, the sleeve being tubular and slideably receiving the tubular portion of the spout.

11. The pitcher of claim 10, wherein the tubular portion of the spout is hollow and the access port is provided in an outer wall thereof.

12. The pitcher of claim 11, wherein the spout includes a pouring portion defining a channel extending from the interior of the hollow tubular portion of the spout to an edge of the cover.

13. The pitcher of claim 12, wherein the sleeve is fixed to the cover.

14. The pitcher of claim 13, wherein the tubular portions of the spout and the sleeve are cylindrical and include engaging screw-thread means, rotation of the spout relative to the sleeve resulting in longitudinal movement of the spout in the sleeve between the sealing and pouring configurations.

15. The pitcher of claim 13, wherein the tubular portions of the spout and the sleeve are cylindrical and the sleeve extends beyond the access port in the sleeve, an access port being provided in the sleeve, in the pouring configuration the access ports being aligned, and rotation of the spout relative to the sleeve misaligning the access ports and sealing the access port in the spout.

16. The pitcher of claim 14 or 15, wherein the pouring portion of the spout includes finger recesses for gripping the spout and facilitating rotation of the spout.

17. The pitcher of claim 10, wherein the diameter of the tubular portion of the spout is lesser than the base of the piercing end to provide a smooth transition from the piercing end to the sleeve when the spout is in the sealing configuration.

18. The pitcher claim 13, wherein the spout includes a grip portion extending above the cover to permit an operator to grip the spout to provide longitudinal movement of the spout in the sleeve between the sealing and pouring configurations.

19. The pitcher of claim 18, wherein the spout includes stop means to provide a stop when the spout is moved to the sealing configuration.

20. The pitcher of claim 19, wherein the stop means is in the form of a ledge for abutting a lower end of the sleeve, the ledge being formed at the base of the piercing end.

21. The pitcher of claim 19, wherein the grip portion is integral with the pouring portion.

22. The pitcher of claim 12, wherein the spout is fixed to the cover.

23. The pitcher of claim 22, wherein the sleeve includes an operating portion for extending through an opening in the cover to permit movement of the sleeve on the spout between the sealing and pouring configurations.

24. The pitcher of claim 23, wherein the sleeve includes stop means extending outwardly of the sleeve rearwardly of the sealing portion to stop the sleeve when the sleeve is moved to the pouring configuration.

25. The pitcher of claim 24, wherein the stop means is in the form of a flange.

26. The pitcher of claim 6, wherein the wall piercing means is provided at a piercing end of the sleeve.

27. The pitcher of claim 24, wherein the sleeve further includes a tubular portion including a sleeve access port and extending rearwardly of the piercing end, the spout also including a tubular portion and slideably engaging the tubular portion of the sleeve.

28. The pitcher of claim 25, wherein the tubular portions of the sleeve and spout are hollow and the access ports are provided in the respective outer wall thereof, the access ports being misaligned in the sealing configuration and aligned in the pouring configuration.

29. The pitcher of claim 28, wherein the tubular portions of the sleeve and spout include detent means to releasably retain the spout relative to the sleeve in one of the sealing and pouring configurations.

30. The pitcher of claim 29, wherein the spout is adapted for rotation in the sleeve.

31. The pitcher of claim 14, 15, 18, 23 or 28, wherein the container is cylindrical.

32. The pitcher of claim 14, 15, 18, 23 or 28, wherein a pusher member is provided spaced from the sleeve for pushing downwardly on one side of an upper wall portion of a pouch and to push the other side of the upper wall portion of the pouch into engagement with the piercing end of the probe.

33. The pitcher of claim 32, wherein a protrusion is provided in the container and extends from a base of the container for abutting and deforming a lower wall portion of a pouch.

34. A pitcher for use in dispensing liquid from a flexible-walled, liquid containing pouch comprising:

a cylindrical, substantially rigid, open-topped container having a base, a side-wall and a handle and of dimensions to contain a flexible-walled, liquid containing pouch;

a cover adapted for engaging an upper portion of the side-wall of the container;

a spout having a conical piercing end for puncturing an upper wall portion of one side of a pouch and a hollow cylindrical portion having an access port in a wall thereof for communication with a pouring portion of the spout;

a cylindrical sleeve mounted on the cover and extending inwardly from an opening therein for receiving the cylindrical portion of the spout in liquid tight relationship and for forming a seal with a puncture hole in an upper wall portion of a pouch outwardly of the piercing end of the spout, the spout being slideably moveable in the sleeve between a sealing and piercing configuration in which the sleeve covers the access port, and a pouring configuration in which the access port is exposed inwardly of the sleeve; and a pusher member mounted on the cover and extending inwardly therefrom and spaced from the sleeve for pushing downwardly on the other side of an upper wall portion of a pouch and to push the one side of the upper wall portion of the pouch into engagement with the piercing end of the spout as the cover is pushed downwardly onto the container to facilitate puncturing of the pouch by the probe.

35. The pitcher of claim 34 and further including detent means between the cover and the container for retaining the cover in one of a series of relative positions.

36. The pitcher of claim 34 or 35, wherein the handle extends longitudinally of the side-wall of the container, and the cover includes a top and a side-wall, the side-wall of the cover including an open-ended slot for accommodating an upper end portion of the handle.

37. A flexible-walled, liquid containing pouch in combination with a pitcher for use in dispensing liquid from the pitcher comprising:

a substantially rigid container adapted to receive the pouch;

a spout having a wall piercing means of tapering cross-section for puncturing a wall of the pouch;

an access port spaced from the wall piercing means and in fluid communication with a pouring portion of the spout;

a sleeve for receiving the spout and having a sealing portion for forming a seal with a puncture hole in the pouch outwardly of the wall piercing means, the spout being moveable relative to the sleeve between a sealing configuration in which the sleeve covers the access port, and a pouring configuration in which the access port is exposed inwardly of the sealing portion in the interior of the pouch; and a support means for mounting one of the spout or sleeve on the container.

* * * * *